US006853346B2

(12) United States Patent
Annabi et al.

(10) Patent No.: US 6,853,346 B2
(45) Date of Patent: Feb. 8, 2005

(54) RF ANTENNA

(75) Inventors: Ayoub Annabi, Dole (FR); Roland Vincent, Dole (FR); Frédéric Diximus, Dole (FR)

(73) Assignee: Amphenol Socapex (FR)

( * ) Notice: Subject to any disclaimer, the term of this patent is extended or adjusted under 35 U.S.C. 154(b) by 102 days.

(21) Appl. No.: 10/293,303

(22) Filed: Nov. 14, 2002

(65) Prior Publication Data

US 2003/0112199 A1 Jun. 19, 2003

(30) Foreign Application Priority Data

Nov. 16, 2001 (FR) ..... 01 14824

(51) Int. Cl.[7] ..... H01Q 9/26
(52) U.S. Cl. ..... 343/803; 343/793; 343/810
(58) Field of Search ..... 343/793, 803, 343/810, 814, 893

(56) References Cited

U.S. PATENT DOCUMENTS 2,655,599 A 10/1953 Finneburgh, Jr. ..... 250/33
5,038,151 A * 8/1991 Kaminski ..... 343/727
5,087,922 A * 2/1992 Tang et al. ..... 343/814
5,440,317 A 8/1995 Jalloul et al. ..... 343/791
5,917,456 A * 6/1999 Teunisse ..... 343/795
6,452,562 B1 * 9/2002 Nyhus ..... 343/810

FOREIGN PATENT DOCUMENTS

FR 1443900 5/1996

* cited by examiner

*Primary Examiner*—Shih-Chao Chen
(74) *Attorney, Agent, or Firm*—Blank Rome LLP

(57) ABSTRACT

The invention provides an elongate antenna having a radiating portion constituted by an elongate conductor element. The elongate element is machined to include: N dipoles (where N is an integer not less than 2) made up of N rectilinear sections of said element in alignment; and N−1 phase-shifter elements, each phase-shifter element being interposed between two consecutive dipoles, each phase-shifter element having a section of the elongate conductor element folded into a U-shape and having branches which are substantially juxtaposed and which extend in a direction that is orthogonal to the common direction of the dipoles.

4 Claims, 2 Drawing Sheets

RF ANTENNA

The present invention relates to an elongate antenna, and particularly but not exclusively to an antenna of this type capable of receiving and transmitting in frequency bands at 1 GHz or higher.

BACKGROUND OF THE INVENTION

A new IEEE standard No. 802.11A or B has come into force concerning the implementation of communications by radio. There are several reasons at the origin of that standard: firstly, there was a desire to have mobile data capture systems capable of working in complete freedom relative to a fixed network; and secondly there was a desire to eliminate numerous cabling operations when installing new applications.

OBJECTS AND SUMMARY OF THE INVENTION

To satisfy those requirements, it is necessary to have an antenna capable of operating at a high frequency, and in particular at a frequency greater than 1 GHz, which antenna should also present high gain. In addition, it is necessary for the antenna to be suitable for being made by low-cost industrial techniques so as to keep the cost of the antenna down, and it is also necessary for the antenna to be fed by means of a coaxial cable.

According to the invention, this object is achieved by an elongate antenna wherein its radiating portion is constituted by an elongate conductor element which is machined so as to make up:

N dipoles (where N is an integer not less than 2) made up of N rectilinear sections of said element in alignment; and N−1 phase-shifter elements, each phase-shifter element being interposed between two consecutive dipoles, each phase-shifter element being constituted by a section of said elongate conductor element folded into a U-shape with branches which are substantially juxtaposed and which extend in a direction that is orthogonal to the common direction of said dipoles, said radiating element being connected at one of its ends to the central conductor of a coaxial cable;

said coaxial cable is provided close to its end connected to the antenna with means forming an impedance-matching cavity; and said coaxial cable is provided close to the impedance-matching cavity on its side remote from the antenna with means constituting a trap for leakage currents.

It will be understood firstly that the antenna can be made at low cost since it suffices to start from a wire element, preferably a single wire element, and to fold it in such a manner as to obtain the N rectilinear dipoles and the N−1 U-shaped phase shifters.

It will also be understood that in spite of its low cost, because of the presence of a plurality of dipoles, it is possible to increase gain in the direction orthogonal to the radiating elements and to obtain a passband of sufficient width to enable all of the bands allocated by the above-mentioned IEEE standard to be accommodated, thus making it possible to achieve transmission or reception at a high data rate of the order of several tens of megabits per second (Mbit/s) if a passband of about 500 MHz is used.

Preferably, the length of each dipole is equal to $\lambda/2$ and the length of each branch of the phase-shifter element is equal to $\lambda/4$, where $\lambda$ is the wavelength of the center frequency of the frequency band in which the antenna operates.

With these characteristics, an antenna is obtained having dimensions that are relatively small for the above-specified band while nevertheless presenting gain and bandwidth that are satisfactory.

Preferably, the radiating portion is constituted by a single elongate conductor element, folded to form the phase shifters. This solution is particularly low in cost.

BRIEF DESCRIPTION OF THE DRAWINGS

Other characteristics and advantages of the invention appear better on reading the description below of an embodiment of the invention given as non-limiting examples. The description refers to the accompanying figures, in which.

MORE DETAILED DESCRIPTION

As already mentioned, the elongate antenna of the invention can be made from a single elongate conductor element which is subjected to machining operations that are very simple since they are constituted merely by operations of folding the conductor in order to obtain the various portions constituting the antenna described below. This elongate element can be constituted, for example, by a strip of brass, preferably a surface-treated strip.

Figure 1:
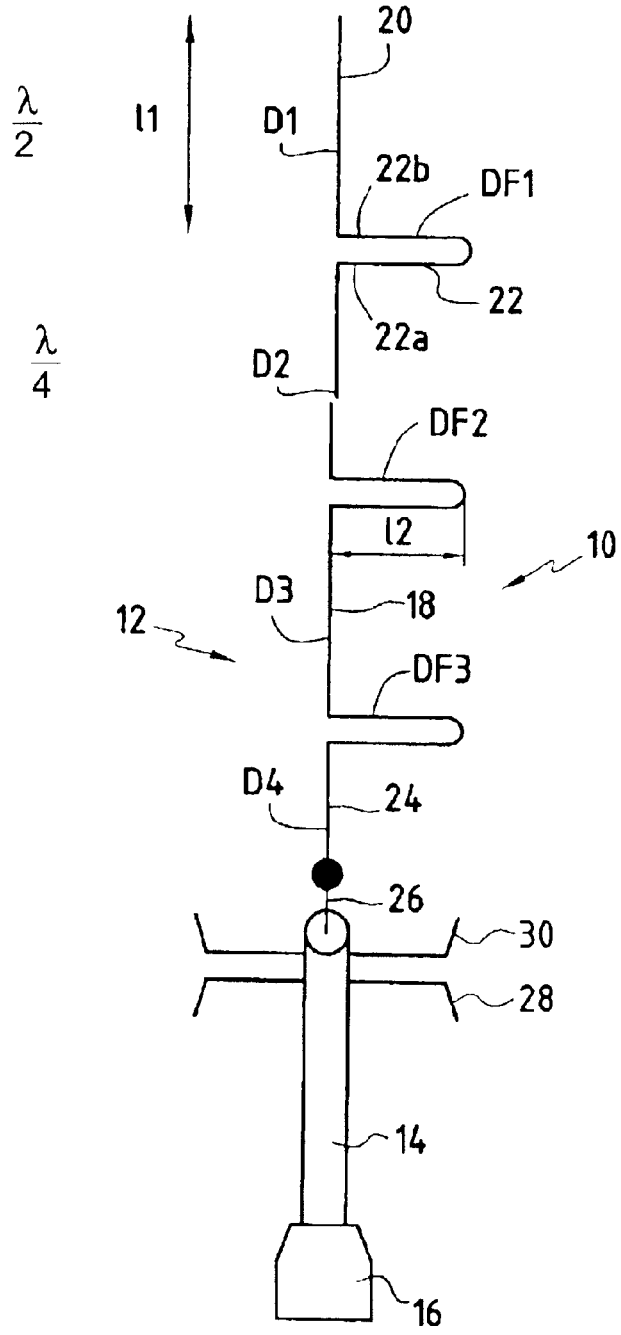
FIG. 1 is a diagrammatic overall view of the antenna.

Accompanying FIG. 1 shows an embodiment of the antenna 10 with its transmission-and-reception portion 12, its antenna conductor 14 constituted by a coaxial cable, and its connector 16. The transmission-and-reception portion 12 or "radiating" portion of the antenna is preferably made from a single conductive strip 18 of constant right section. It would not go beyond the invention for the antenna to be made up of a plurality of interconnected conductor elements having different sections, for example. The element 18 is folded in the embodiment described so as to constitute dipoles D1, D2, D3, . . . , $D_N$ and phase shifters DF1, DF2, DF3, . . . , $DF_N'$. Each dipole D is constituted by a rectilinear portion of conductor strip 20 of length l1 corresponding to $\lambda/2$, where $\lambda$ is the center wavelength of the transmission-reception frequency band. All of the dipoles are identical and in alignment.

Each phase-shifter element DF interposed between two dipoles is constituted by a U-shaped portion of conductor strip 22 having two branches 22*a* and 22*b* which are substantially juxtaposed extending in a common direction that is substantially orthogonal to the common direction of the dipoles D. The length l2 of each branch of the phase-shifter circuit DF is equal to $\lambda/4$ where $\lambda$ has the same value as for the dipoles.

Given their direction, the phase shifters DF can be considered as acting neither as transmission radiating elements nor as reception radiating elements. They perform a phase-shifting function.

The bottom dipole D4 is electrically connected at point 24 to the center conductor 26 of the antenna coaxial cable 14.

The elongate element or strip used for making the transmission-reception portion 12 of the antenna preferably presents a right section that is rectangular being about 4 millimeters (mm) in width. This section serves to increase the width of the passband and ensures that the antenna has appropriate mechanical properties.

In a preferred embodiment which corresponds to a working frequency band lying in the range 5.725 GHz to 5.875 GHz, the physical length of the dipoles D is equal to 26 mm and the total physical length of the U-shaped phase shifters is equal to 26 mm.

In the example described, there are four dipoles D1, D2, D3, and D4, which corresponds to a good compromise between the antenna having sufficient gain and also being acceptably compact. Nevertheless, it is naturally possible to select a value for N other than 4. Similarly, it is possible to select a value for N' that is other than 3.

Naturally, the design of this antenna is suitable for the following frequency bands:

5.250 GHz to 5.350 GHz;

5.350 GHz to 5.470 GHz;

5.470 GHz to 5.720 GHz.

In the above-described embodiment, all of the dipoles D are of the same length and that length corresponds to half the center wavelength λ.

To further broaden the bandwidth of the antenna, it is possible for each dipole D1, D2, D3, and D4 to be given an electrical length corresponding to respective wavelengths λ1, λ2, λ3, λ4 that are offset relative to one another.

Figure 2:
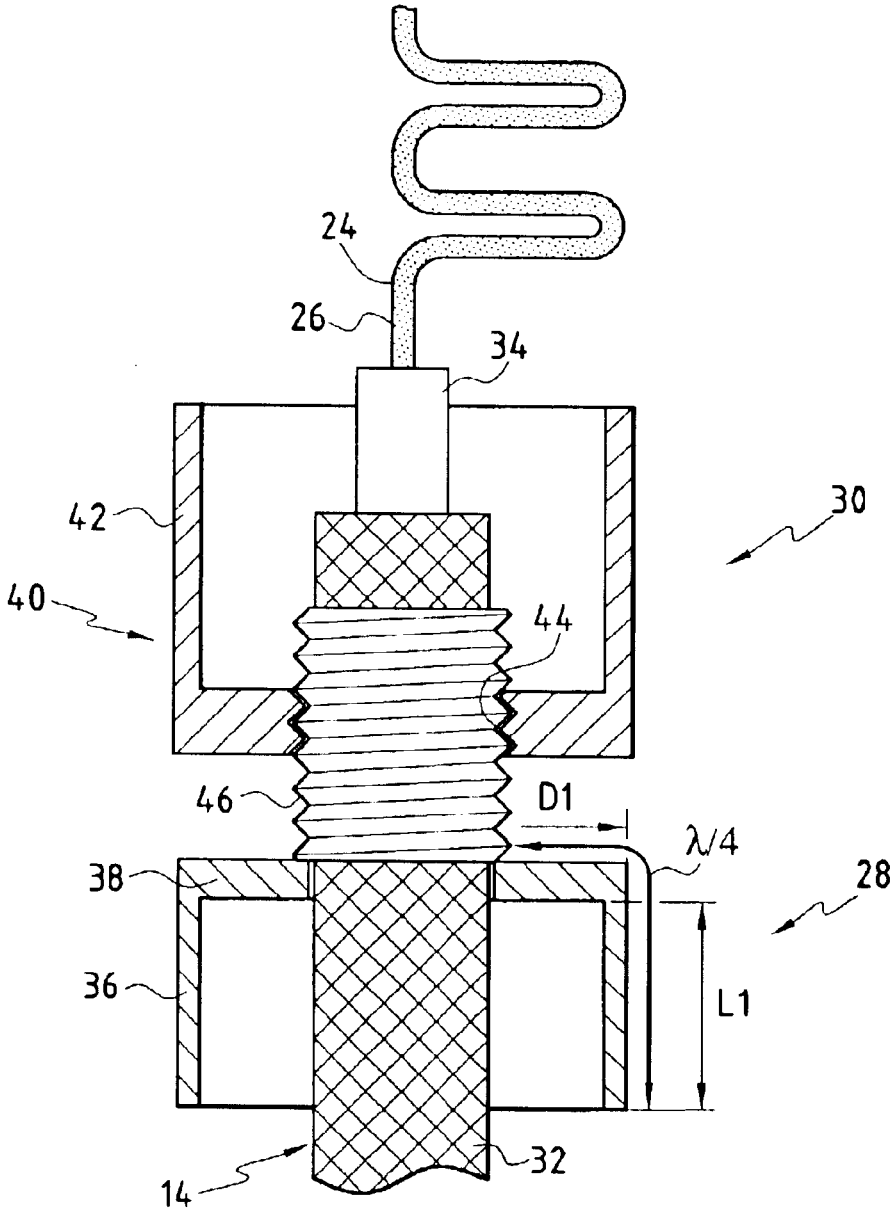
FIG. 2 is a detail view showing a preferred form of connection between the radiating portion and the coaxial cable.

FIG. 2 shows a preferred embodiment of a current trap 28 and an impedance matcher 30 in greater detail.

This figure shows the coaxial cable 14 with its shielding 32, its intermediate insulation 34, and its axial conductor 26 which is connected to the end 24 of the radiating element of the antenna.

The current trap 28 is constituted by a conductive cylinder 36 disposed coaxially about the cable 14, being downwardly open and connected at its top end to the shielding 32 by a conductive ring 38. The length L1 of the cylinder and the width $D_1$ of the ring are such that $D_1+L_1=\lambda/4$ where λ is the operating wavelength.

Impedance matching 30 is performed by means of a conductive cylinder 40 whose bottom end is connected to a conductive ring 42 presenting axial tapping 44. The tapping 44 co-operates with a threaded ring 46 mounted on the coaxial cable.

By adjusting the axial position of the cylinder 40 relative to the end of the coaxial cable 14, it is possible to adapt the impedance of the radiating element so that it matches that of the cable.

What is claimed is:

1. An elongate antenna adapted to be connected to a coaxial cable having a central conductor and comprising:

a radiating portion constituted by an elongate conductor element which is machined so as to make up:

N dipoles, where N is an integer not less than 2, made up of N rectilinear sections of said element in alignment; and N−1 phase-shifter elements, each phase-shifter element being interposed between two consecutive dipoles, each phase-shifter element being constituted by a section of said elongate conductor element folded into a U-shape with branches which are substantially juxtaposed and which extend in a direction that is orthogonal to the common direction of said dipoles, said radiating portion having two ends between which said dipoles and said phase-shifter elements are disposed, said coaxial cable being connected at said central conductor provided on one of said two ends of the radiating portion;

means forming an impedance matching cavity mounted on said coaxial cable close to its end connected to said radiating portion; and means forming a trap of leaked currents, said trap means being mounted on said cable, on the side of said impedance cavity remote from said radiating portion.

2. The antenna according to claim 1, wherein the length of each dipole is equal to λ/2 and the length of each branch of the phase-shifter element is equal to λ/4, where λ the wavelength of the center frequency of the frequency band in which the antenna operates.

3. The antenna according to claim 1, wherein the radiating portion is constituted by a single elongate conductor element, folded to form said phase shifter elements.

4. The antenna according to claim 1, wherein the radiating portion of the antenna is made from a single conductive strip of constant right section which is folded to form the phase shifter elements.

* * * * *